US005836146A

United States Patent [19]

König

[11] Patent Number: 5,836,146

[45] Date of Patent: Nov. 17, 1998

[54] METHOD OF AND APPARATUS FOR PRODUCING THICK REGIONS IN A FILAMENT YARN

[75] Inventor: Günter König, Uhingen, Germany

[73] Assignee: Zinser Textilmaschinen GmbH, Ebersbach/Fils, Germany

[21] Appl. No.: 938,414

[22] Filed: Sep. 25, 1997

[30] Foreign Application Priority Data

Sep. 30, 1996 [DE] Germany ..... 196 40 405.3

[51] Int. Cl.[6] ..... D01H 13/26

[52] U.S. Cl. ..... 57/287; 57/290; 264/288.8; 264/290.5; 428/369

[58] Field of Search ..... 57/287, 288, 290; 264/167, 210.2, 210.5, 288.8, 290.5; 428/369, 397, 399, 400

[56] References Cited

U.S. PATENT DOCUMENTS

| | | | |
|---|---|---|---|
| 4,044,089 | 8/1977 | Cochran et al. | 264/167 |
| 4,684,566 | 8/1987 | Sasaki et al. | 428/224 |

FOREIGN PATENT DOCUMENTS

| | | | |
|---|---|---|---|
| 832966 | 10/1997 | European Pat. Off. . | |
| 38 41 525 | 6/1990 | Germany . | |
| 195 29 315 | 2/1997 | Germany . | |
| 195 29 315 A1 | 2/1997 | Germany . | |
| 196 26 031 A1 | 10/1997 | Germany . | |
| 196 26 032 A1 | 1/1998 | Germany . | |
| 57-191319 | 11/1982 | Japan . | |
| 25771 | 6/1987 | Japan | 57/288 |
| 6-017337 | 1/1994 | Japan . | |
| 6-17337 | 1/1994 | Japan . | |
| 7-048746 | 2/1995 | Japan . | |

*Primary Examiner*—William Stryjewski
*Attorney, Agent, or Firm*—Herbert Dubno

[57] ABSTRACT

The distribution of thick regions along a filament yarn can have a random character if the thick regions of a filament from a first stretching zone are heated in a second stretching zone and thereby permitted to stretch and reduce in thickness. The heating in the second zone is out of phase with the thick regions of the first stretching zone.

14 Claims, 5 Drawing Sheets

METHOD OF AND APPARATUS FOR PRODUCING THICK REGIONS IN A FILAMENT YARN

FIELD OF THE INVENTION

My present invention relates to a method of and to an apparatus for producing thick regions in a filament yarn and, more particularly, to the texturing of filament yarn in part by stretching thereof.

BACKGROUND OF THE INVENTION

When mention is made of a filament yarn here, I intend to refer to a yarn which is capable of being stretched to cause thinning thereof and, in particularly, can be heated to permit such extension as will result in a reduction of the cross section, usually the diameter of the filament.

In JP-HEI-6-17337 it is known to form an endless synthetic thermoplastic filament or a yarn comprised thereof, with randomly or regularly distributed thick regions. For this purpose, the filament yarn may be wound around a roller which may be supported by a plurality of springs on a support member. The springs and rollers generate at certain distances from one another, thick regions between which the yarn is drawn out into thinner regions.

Chemical fibers can be formed with sections with different melting temperatures so that the application of heat coupled with tension can stretch out the yarn between regions selectively. The stretching rollers can be provided with grooves (DE 38 41 525 A1) in which regions of the filaments are not heated. Because of the different melting temperatures, the filaments can be fused together with one another. For producing textures with randomly distributed thick regions as to the lengths and spacing of these regions, this approach is not satisfactory.

Efforts have been made to provide, along the path of the yarn, two stretching fields or zones with different stretch ratios in each of the two zones with the distribution of the stretch regions between the two zones being briefly varied to achieve alternating thick and thin regions (DE 195 29 315). A device for carrying out this method can, according to DE 196 26 032 have a heating unit for heating portions of the yarn to be stretched. This heating unit can include a disk whose periphery is rotatable in contact with the yarn and which has, at a location along the periphery, a recessed portion, i.e. a region of reduced radius, being provided along the periphery so that, when the reduced radius portion is juxtaposed with the filament, the latter is not heated and hence the stretching field tends to elongate the yarn to a lesser degree and leave a thicker region therein.

These latter systems tend to provide a certain uniformity of the lengths of the thick regions and their spacings in the yarn so that, when the yarn is woven into a fabric or knitted into a fabric, the regularity of the thick regions causes moire patterns to form therein. These patterns are a result of the periodicity of the thick regions or of their lengths or spacings.

It thus is desirable to be able to generate thick regions in a filament yarn with a high degree of randomness both with respect to the lengths of the thick regions and their spacing along the yarn.

OBJECTS OF THE INVENTION

It is, therefore, the principal object of the present invention to provide an improved method of and apparatus for generating a random distribution of thick regions in a filament yarn in a relatively simple way both with respect to the lengths of the thick regions and with respect to the spacings thereof.

It is an object of the invention where, thick regions are provided in a yarn in a more or less regular pattern or even a partially random pattern, to increase the randomness of the distribution of the thick regions.

SUMMARY OF THE INVENTION

These objects are attained, in accordance with the invention, by providing, along the path of a filmament yarn, an upstream stretching zone or field and a downstream stretching zone or field and generating thick regions in the upstream zone which can be of a regular pattern or can be generally random, by imparting randomness to the distribution of the thick regions or increasing the degree of randomness thereof in the second stretching zone. In the second stretching zone to increase the randomness or create randomness, the thick regions are caused to be heated at least in part so that the heated portions can be further stretched, the application of heat being intermittent and over only portions of the previously formed thick regions. The stretching in the second zone is a partial stretching of the filament or can be a full stretching thereof, a stretching of portions to the maximum stretch to be imparted to the yarn for strengthening same. The effect, therefore, is a randomization of the lengths of the thick regions and/or their spacings even if the thick portions form the upstream zone arrive in a regular pattern. Where the thick regions from the upstream zone are already more or less random, the intermittent contact of the thick regions with the heating unit and the stretching can increase the degree of randomness of the thick regions which remain. More particularly, the method of the invention can comprise the steps of:

(a) displacing a filament which can be thinned by stretching and can be stretched upon heating along a path;

(b) stretching the filament at an upstream first zone along the path and, independently of stretch applied to the filament at the first zone, stretching the filament at a second zone of the path downstream of the first zone;

(c) forming the filament in the first zone with initial thick regions of first lengths spaced apart with first spacings along the filament; and (d) at time-spaced intervals, heating portions of at least some of the initial thick regions along the second zone while the filament is stretched in the second zone to thin out heated portions of the initial thick regions and vary lengths and spacings of remaining thick regions along the filament, thereby generating a generally random distribution of thick regions along the filament with respect to lengths and spacings thereof.

In apparatus respects the apparatus for producing the thick regions in the filaments yarn can comprise:

means for displacing a filament which can be thinned by stretching and can be stretched upon heating along a path;

first stretching means along the path for stretching the filament at an upstream first zone along said path;

second stretching means along the path for stretching the filament, independently of stretch applied to the filament at the first zone, at a second zone of the path downstream of the first zone;

means for forming the filament in the first zone with initial thick regions of first lengths spaced apart with first spacings along the filament; and a heat source along the second zone for, at time-spaced intervals, heating portions of at least some of the initial thick regions along the second zone while the filament is stretched in the second zone to thin out heated portions of the initial thick regions and vary lengths and spacings of remaining thick regions along the filament, thereby generating a generally random distribution of thick regions along the filament with respect to lengths and spacings thereof.

The spacing distribution and the length distribution of the thick regions along the filament and the effect of the heat on the travelling filament can be uniform (spacing and length or interval and duration being the same, equal or differing from one another). They can be nonuniform but somewhat periodic with alternating spacing and/or lengths or intervals and/or duration of heating, which again may be the same or different, but will be repetitive in accordance with the periodicity. Alternatively, the thick regions may be nonuniform in any respect. All three possibilities can be combined and the spacing and length parameters can be varied as the oncoming filament reaches the heating location.

A uniform distribution of the thick regions reaching the second zone can be generated by a heating source in which the filament yarn contacts a heating surface of a rotating heating element whose periphery has at least one region of reduced radius as measured from the rotation axis. In this case, the thick regions have the same spacings along the filament and the same lengths.

According to the invention, when the thick regions have a regular distribution along the filament and contact a rotating disk with one or more peripheral recesses for heating of portions of the thickened regions and the periodicity of the disk is different from the periodicity of the thickened regions reaching a location in the second zone, the result will be a high degree of randomness of the lengths of the thick regions and their spacings from one another. In all cases, the tension applied in the stretching tends to draw out the heated portions of the thick regions and thereby reduce the thickness thereof at these locations and increase the spacings between the remaining thick portions.

Instead of a disk as described, the heating of the filament can be effected by alternately shielding and transmitting heat from a heating source, preferably a radiation source onto the filament. Best results are obtained when the heating effect is totally irregular or periodic with a limited degree of regularity.

A periodic distribution with a certain degree of irregularity can result when the disk which is used to heat the thick portion is formed along its periphery with irregularly spaced recesses of different arc lengths and/or the disk speed is varied in an irregular manner, and/or the pattern of heating is phase-shafted from the frequency with which the thick regions pass a location in the second one and/or is of a different frequency than the latter.

When heated disks with recesses are used to locally heat the filament yarn, the speeds of the disks can be varied in a random manner to further increase the randomness.

Purely randomly distributed thick regions can be generated in a filament yarn which is not fully oriented by incomplete stretching so that the degree of stretch varies along the yarn. A purely random effect of heat can be obtained, for example, by coupling the heating source to a random generator which cuts off, shields, or turns on the heating source in a random and controlled manner.

Heating of the filament yarn can be effected in other ways than by the heated disks described and the duration of heating can be controlled by interrupting or altering the rate of drawing of the filament yarn and/or blowing hot air on the filament yarn or in combination thereof. It will be apparent that an important aspect of the invention is that randomness in the distribution of thickened regions is increased by reducing the lengths of previously formed regularly or irregularly generated thickened regions and hence, when there are limits to the extent to which the number of lengths of thickened regions can be reduced, a corresponding increase in the number of thickened regions and their lengths must be provided in the first stage.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
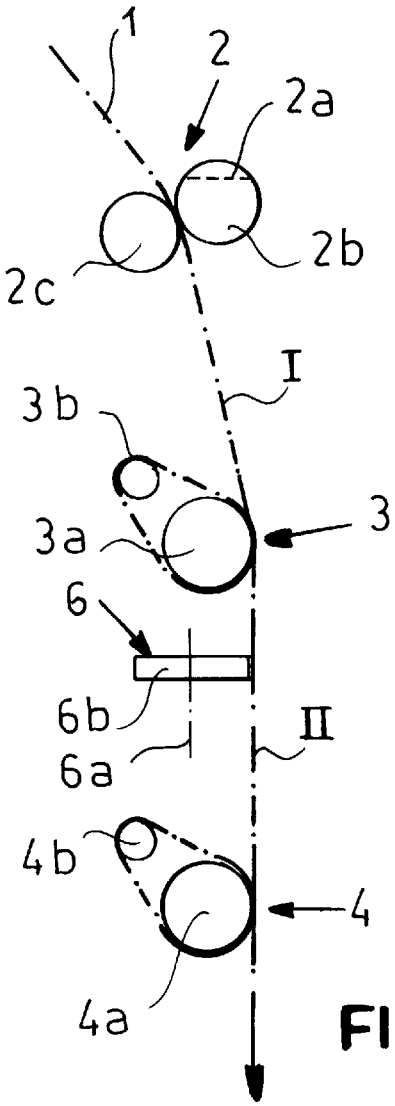
FIG. 1 is a schematic illustration of an apparatus for carrying out the invention in a first embodiment.
Figure 2:
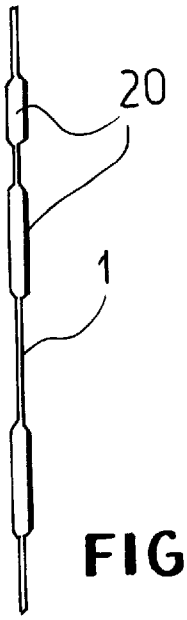
FIG. 2 is an elevational view in highly diagrammatic form and greatly enlarged in scale of the filament yarn in the first stretching zone of the apparatus of FIG. 1.

FIG. 1 shows an apparatus for producing randomly distributed thick locations generally represented at 20 in a filament yarn which has been represented at 1 and which is shown in FIG. 2 in the first stretching zone I of the apparatus of FIG. 1 between a feed roller pair and a gallet 3. The latter, as is customary, comprises a drum 3*a* around which the yarn 1 is looped in a plurality of turns, being further looped over a roller 3*b* spaced from the gallet 3*a*. The roller pair 2 can operate with a peripheral speed slightly less than the peripheral speed of the gallet 3 so that a stretch is generated in zone I.

When the stretch in the zone I is applied to incompletely oriented yarn I, thick regions 20 of variable spacing and length are formed along the yarn, e.g. by randomly relaxing the stretch as can be achieved for example, by providing a flat as shown at 2*a*, for example, on the roller 2*b* of the roller pair 2. In the region of this flat, the stretch is relaxed and a thick portion can pass through the nib between the rollers 2*b* and 2*c* of the roller pair 2. Other systems for initially generating the thick portions are also available and particular reference may be made to my copending application Ser. No. 08/823,639 filed Mar. 25, 1997 which discloses techniques which can be used for generating thick/thin regions in a filament yarn.

The filament yarn which is thermoplastic in the sense that heated portions thereof can be stretched to draw out the heated portion and thin the heated portion if it is part of one of the previously formed thick regions previously described, thereupon passes into the second stretching field or zone II.

Note that fully stretched or oriented regions are not affected by the heat and usually are not thinned further in the same ratio.

The second stretching field II is provided between the gallet 3 and a gallet 4 which comprises a drum 4 and a roller 4*b* about which the yarn 1 is looped in a plurality of turns. The peripheral speed of the gallet 4 is higher than the periphery speed of the gallet 3 so that a continuous stretch is applied to the yarn in the zone II. In this second zone II a heating source 6 is provided, preferably in the form of a heated disk with at least a portion 6.1 of reduced radius, the disk being rotatable about an axis 6*a* parallel to the filament 1 and having a periphery 6*b* which can contact the thickened portions 20 of the filament in the regions of the periphery between the reduced radius portions 6.1.

The apparatus of FIG. 1 is so constructed, therefore, that in the first stretching zone I between the roller pair 2 and the gallet 3, the thick regions 20 are formed along the filament yarn while in the second stretching zone II, the thick regions 20 are partially and intermittently heated by the source 6 so that, because of the tension generated in the zone II, these heated portions are further stretched.

Figure 3:
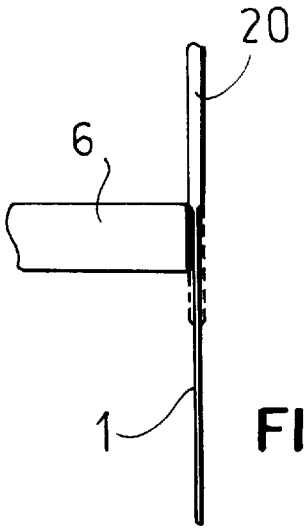
FIGS. 3 and 4 are illustrations of the scale of FIG. 2 of the effect of the heated disk in the second stretching zone of FIG. 1.
Figure 4:
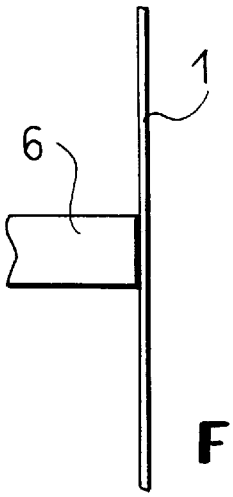

From FIG. 3 it will be apparent that an incompletely stretched portion of the filament yarn 1, i.e. a leading portion of a thick region, can come into contact with the heating source 6 and under tension in the zone II further stretched out to reduce the thickness of that yarn over the broken line region from the thickness of the thick region 20 to that of the yarn between the thick regions. When a thin region (FIG. 4) passes the disk 6, there is no change in the yarn thickness since it is either fully stretched or does not contact the heated periphery of the disk with the same heating effect and thus this region does not stretch further.

Figure 5:
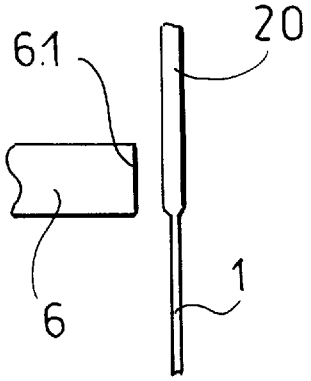
FIGS. 5 and 6 are elevational views showing the juxtaposition of the disk and the filament yarn in the region of a recess or area of reduced radius.
Figure 6:
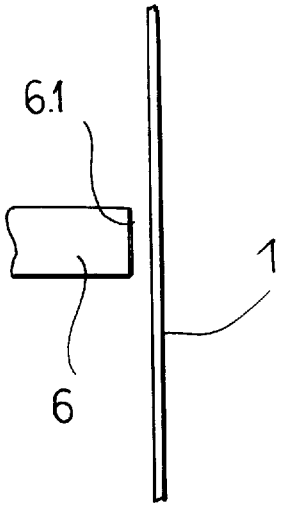

As can be seen from FIG. 5, when a thick region 20 passes the reduced-radius portion 6.1 of the disk 6, the thick region is unheated and thus unstretched further. FIG. 6 shows the position of the yarn 1 and the disk 6, a previously stretched and hence thin region passes the reduced radius portion 6.1.

Figure 7:
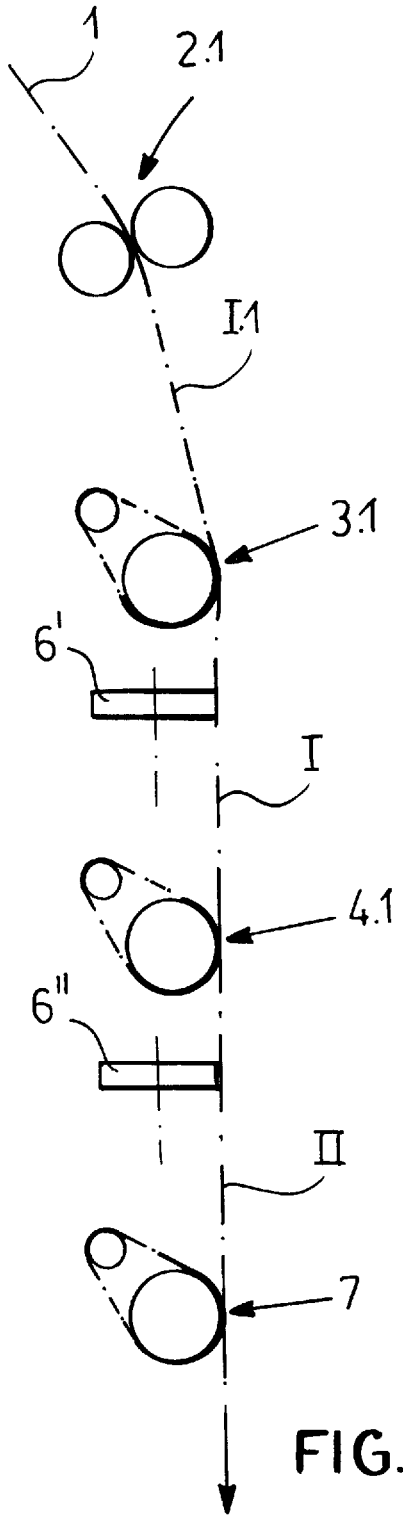
FIGS. 7 and 8 are views similar to FIG. 1 showing other embodiments of the apparatus of the invention.

In FIG. 7 I have shown another embodiment of the invention wherein, upstream of the first stretching zone I, a zone I.1 is provided under only slight tension between a roll pair 2.1 and the upstream gallet 3.1. The first stretching field or zone I is then defined between this gallet 3.1 and a downstream gallet 4.1 in which the thickened portions 20, as shown in FIG. 2, are generated. In the case of an incompletely oriented filament yarn, these thickened portions 20 can be produced by intermittent contact heating disk 6' with the filament and the stretching of the heated portions. The disk has one or more reduced diameter portions (see FIGS. 11, 12) which are of reduced diameter in which the filament is not contacted. In the regions of the filament 1 which are not contacted by the heated disk 6', the filament is unstretched in zone I and remains a thick region.

When a single recess is provided in the periphery of the heated disk 6' and the latter is rotated at a constant speed, the thick regions are all of equal length and equal spacing. When the disk 6.1 has regions of reduced radius of different arc length, the distances between the thick regions and their lengths also will vary for each rotation of the disk. Thus a certain amount of irregularity is provided in the spacing and lengths of the thick regions even though sone periodicity is imparted.

Figure 8:
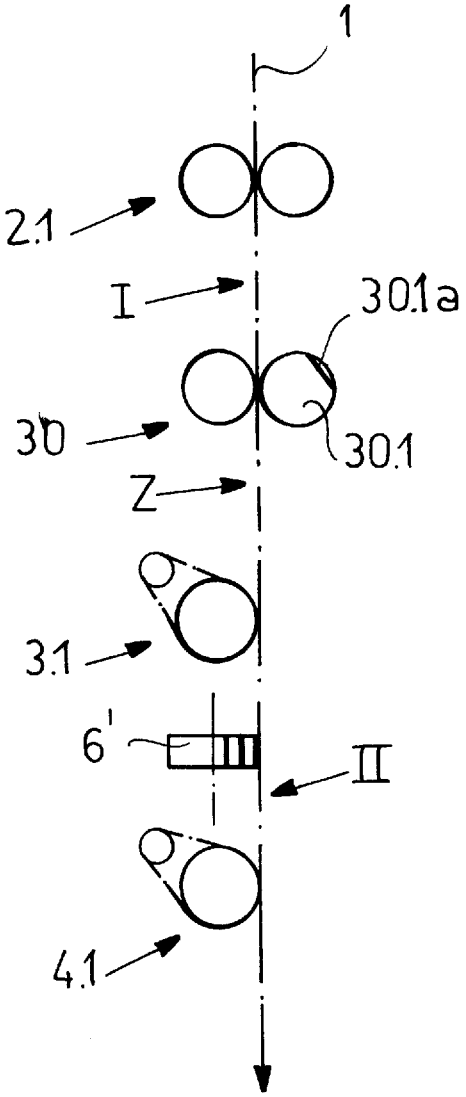

Between the gallet 4.1 and a further gallet 7, a second stretching zone II is provided in the embodiment of FIG. 8 and a second heating source 6" in the form of a rotation disk is provided. In this zone II, the thickened portions are partly heated in a pattern which increases the overall randomness of the distribution of the thickened regions as to length and spacing as has been described in connection with FIG. 1.

FIG. 8 shows a further embodiment of the invention in which between the stretching zone I and the stretching zone II, an intermediate zone Z is provided in which the filament 1 is at a reduced tension. This intermediate zone can be defined between the first zone I and the gallet 3.1 by a roller pair having a roller 30.1 with a flat 30.1*a*. When the flat 30.1*a* is turned to the nip, the separation between zone I and the intermediate zone Z is interrupted and a single stretching zone with a single stretch ratio is generated. The range of stretch provided by the combination of the intermediate zone and the initial zone I is thus increased by comparison with a system in which a fixed initial zone is provided. Stretching in zone II is unaffected.

Figure 9A:
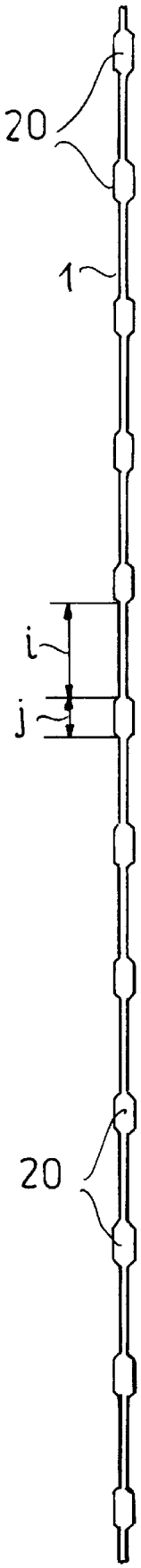
FIGS. 9*a*, 9*b* and 9*c* are views illustrating the randomness generated by the outer phase heating and thickened regions in a regular pattern of a filament yarn.
Figure 9B:
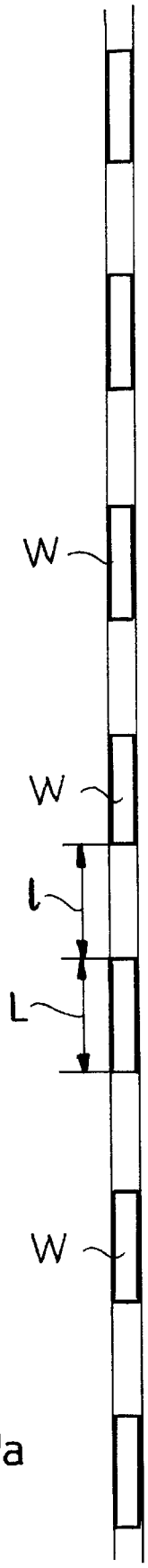
Figure 9C:
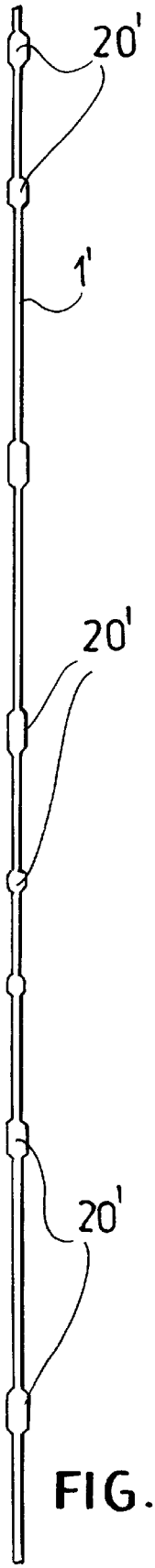

FIGS. 9*a*–9*c* show the effect of heating at intervals W of durations represented by the length L and with spacings 1 between them, on a filament 1 having thick portions 20 with a spacing i and a length j has been shown in FIG. 9*c*. The thick portions 20' of the resulting filament 1' are more or less random in length and spacing. Of course, the additional stretch in the second zone represented at the lower half of FIG. 9*c* is effected only when the heating W coincides with a thick region 20 of the yarn from the first stage. In the absence of heating the thick regions are unaffected as has been shown for the second thick region from the bottom (FIGS. 9*a* and 9*c*). Thick regions which are only partially coincident with a heating zone W are only stretched out in the heated regions.

With this apparatus, the length and spacing of the thick regions and the duration and interval of heating become substantially random and the result is a yarn with randomly distributed thick regions and thick regions of randomly varying length so that, upon conversion of the yarn to a fabric, the texture of natural silk or linen can be obtained and the periodicity which can result in undesired moire patterns can be precluded. All of the parameters with respect to the thick region formation can, of course, be varied with or in addition to the travel of the yarn.

Figure 11:
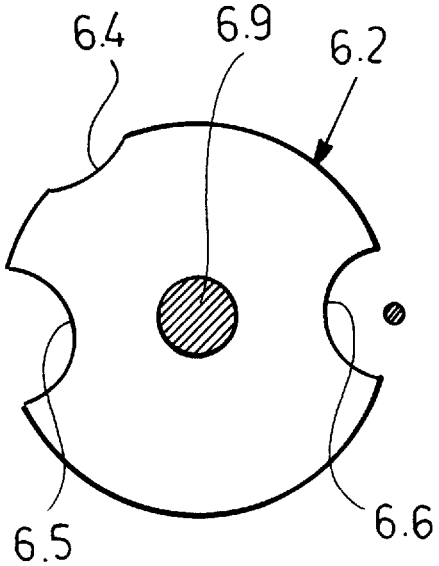
FIGS. 11 and 12 are plan views through disks which can be used in successive stages such as the two zones of FIG. 7 in which heating disks are used.
Figure 12:
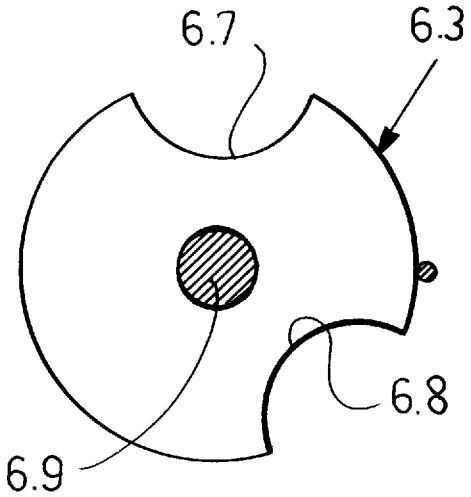

In FIG. 11 I have shown a typical heated disk 6.2 which can have a plurality of irregularly spaced recesses 6.4, 6.5, 6.6 of different arc lengths and spacings to contribute to the randomness previously described. In FIG. 12 the heated disk 6.3 has recess portions 6.7 and 6.8 which can be of equal arc length but are spaced by different arc lengths of the heating periphery of the disk from one another. Both disks are mounted on shafts 6.9 so that they can be driven by appropriate motors whose speeds can be varied as may be desired.

Figure 10:
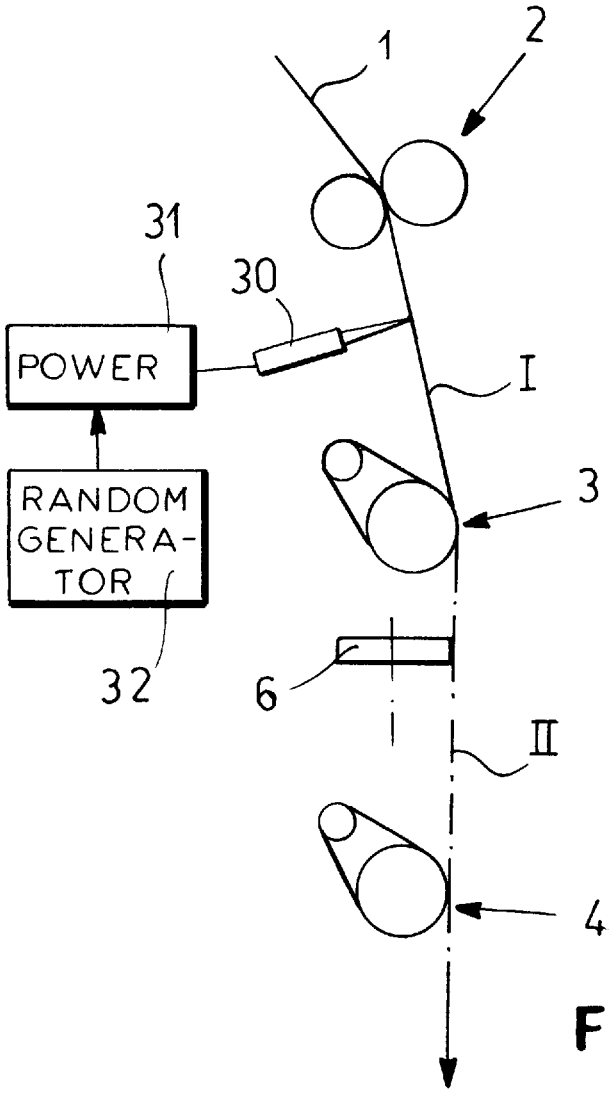
FIG. 10 is a view similar to FIG. 7 showing another embodiment of the invention.
Figure 13:
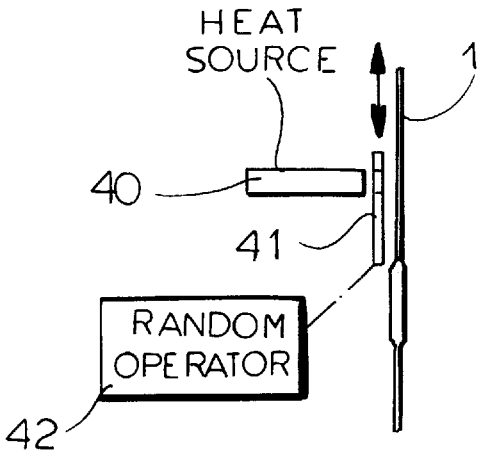
FIG. 13 is a detail of the heating region in a second zone of one of the apparatuses showing the use of a randomly displaced shield.

In FIG. 10 the filament 1 is heated in zone I by a hot-air jet or a laser source represented at 30 whose input power 31 is controlled by a random generator 32. The second stage heating can be effected by the heated disk 6 previously described. In FIG. 13 the heating source 40, which can be a source of hot air, can be intermittently blocked by a shield or shutter 41 displaced by a random operator 42 to heat the yarn 1 for stretching to stretch out thickened regions which may be so heated.

I claim:

1. A method of producing thick regions along a filament yarn, comprising the steps of:

(a) displacing a filament which can be thinned by stretching and can be stretched upon heating along a path;

(b) stretching said filament at an upstream first zone along said path and, independently of stretch applied to said filament at said first zone, stretching said filament at a second zone of said path downstream of said first zone;

(c) forming said filament in said first zone with initial thick regions of first lengths spaced apart with first spacings along said filament; and (d) at time-spaced intervals, heating portions of at least some of said initial thick regions along said second zone while said filament is stretched in said second zone to thin out heated portions of said initial thick regions and vary lengths and spacings of remaining thick regions along said filament, thereby generating a generally random distribution of thick regions along said filament with respect to lengths and spacings thereof.

2. The method defined in claim 1, further comprising the step of varying said first lengths along said filament.

3. The method defined in claim 1, further comprising the step of varying said first spacings along said filament.

4. The method defined in claim 1, further comprising the step of imparting randomness to said first lengths and spacings along said filament.

5. The method defined in claim 1 wherein the heating of at least some of said initial thick regions along said second zone while said filament is stretched in said second zone is effected at equal or different time intervals for equal or different durations.

6. The method defined in claim 1 wherein the heating of at least some of said initial thick regions along said second zone while said filament is stretched in said second zone is effected at equal time intervals with a frequency different from a frequency with which said thick regions pass a location along said path in said second zone.

7. The method defined in claim 1 wherein heating of said filament is effected in said second zone for equal or different durations.

8. An apparatus for producing thick regions along a filament yarn, comprising:

means for displacing a filament which can be thinned by stretching and can be stretched upon heating along a path;

first stretching means along said path for stretching said filament at an upstream first zone along said path;

second stretching means along said path for stretching said filament, independently of stretch applied to said filament at said first zone, at a second zone of said path downstream of said first zone;

means for forming said filament in said first zone with initial thick regions of first lengths spaced apart with first spacings along said filament; and a heat source along said second zone for, at time-spaced intervals, heating portions of at least some of said initial thick regions along said second zone while said filament is stretched in said second zone to thin out heated portions of said initial thick regions and vary lengths and spacings of remaining thick regions along said filament, thereby generating a generally random distribution of thick regions along said filament with respect to lengths and spacings thereof.

9. The apparatus defined in claim 8 wherein said filament is formed in said first zone with initial thick regions of equal length and spacings, said heat source being provided with means for applying heat to said heated portions for irregular durations or at irregular intervals.

10. The apparatus defined in claim 8 wherein said filament is formed in said first zone with initial thick regions of equal length and spacings, said heat source being provided with means for applying heat to said heated portions for equal durations or at equal intervals in a sequence differing from a sequence at which said initial thick regions pass a location in said second zone.

11. The apparatus defined in claim 8 wherein said means for forming said filament with initial thick regions includes another source for heating said filament.

12. The apparatus defined in claim 8 wherein said means for forming said filament with initial thick regions includes means for establishing a high stretch field at an upstream portion of said first zone and a reduced stretch field at a downstream portion of said first zone.

13. The apparatus defined in claim 8 wherein said source includes a rotatable heated disk having a periphery contacting said filament, and at least one region of reduced radius in which said periphery is recessed from contact with said filament to prevent heating of said filament.

14. The apparatus defined in claim 8 wherein said means for forming said filament with initial thick regions includes another source for heating said filament, each of said sources including a respective rotatable heated disk having a periphery contacting said filament, and at least one region of reduced radius in which said periphery is recessed from contact with said filament to prevent heating of said filament.

* * * * *